US007546751B2

(12) United States Patent
Lutz

(10) Patent No.: US 7,546,751 B2
(45) Date of Patent: Jun. 16, 2009

(54) GARMENT

(76) Inventor: Thomas Lutz, Am Hafen 7a, Erlangen (DE) 91056

( * ) Notice: Subject to any disclaimer, the term of this patent is extended or adjusted under 35 U.S.C. 154(b) by 139 days.

(21) Appl. No.: 10/575,766

(22) PCT Filed: Oct. 13, 2004

(86) PCT No.: PCT/DE2004/002273

§ 371 (c)(1),
(2), (4) Date: Dec. 19, 2006

(87) PCT Pub. No.: WO2005/039336

PCT Pub. Date: May 6, 2005

(65) Prior Publication Data

US 2007/0149093 A1 Jun. 28, 2007

(30) Foreign Application Priority Data

| | | |
|---|---|---|
| Oct. 15, 2003 | (DE) | 203 15 842 U |
| Oct. 15, 2003 | (DE) | 203 15 843 U |
| Mar. 2, 2004 | (DE) | 20 2004 003 183 U |
| Mar. 2, 2004 | (DE) | 20 2004 003 184 U |

(51) Int. Cl.
*A41B 9/00* (2006.01)

(52) U.S. Cl. ..... 66/177; 66/171

(58) Field of Classification Search ..... 66/170, 66/171, 169 R, 177, 175, 176
See application file for complete search history.

(56) References Cited

U.S. PATENT DOCUMENTS

| | | | | |
|---|---|---|---|---|
| 3,824,812 | A * | 7/1974 | Matthews et al. | 66/177 |
| 5,465,594 | A * | 11/1995 | Imboden et al. | 66/177 |
| 5,537,690 | A * | 7/1996 | Johnson | 2/44 |
| 5,605,060 | A * | 2/1997 | Osborne | 66/171 |
| 5,823,851 | A * | 10/1998 | Dicker | 450/2 |
| 6,023,789 | A * | 2/2000 | Wilson et al. | 2/228 |
| 6,086,450 | A * | 7/2000 | Mankovitz | 450/20 |
| 6,272,888 | B1 * | 8/2001 | Fujita et al. | 66/172 E |
| 6,899,591 | B2 * | 5/2005 | Mitchell | 450/65 |
| 7,017,367 | B2 * | 3/2006 | Kagitani et al. | 62/540 |

* cited by examiner

*Primary Examiner*—Danny Worrell
(74) *Attorney, Agent, or Firm*—Thomas R. Vigil

(57) ABSTRACT

Garment consisting of seamless circular-knit cotton or circular-knit polyamide (microfiber yarn) with a component of elastane, whereby the garment is provided with zones of variable elasticity (1-5), whereby compression zones of higher elasticity (4, 5), which therefore provide greater support, are knitted into the garment.

21 Claims, 6 Drawing Sheets

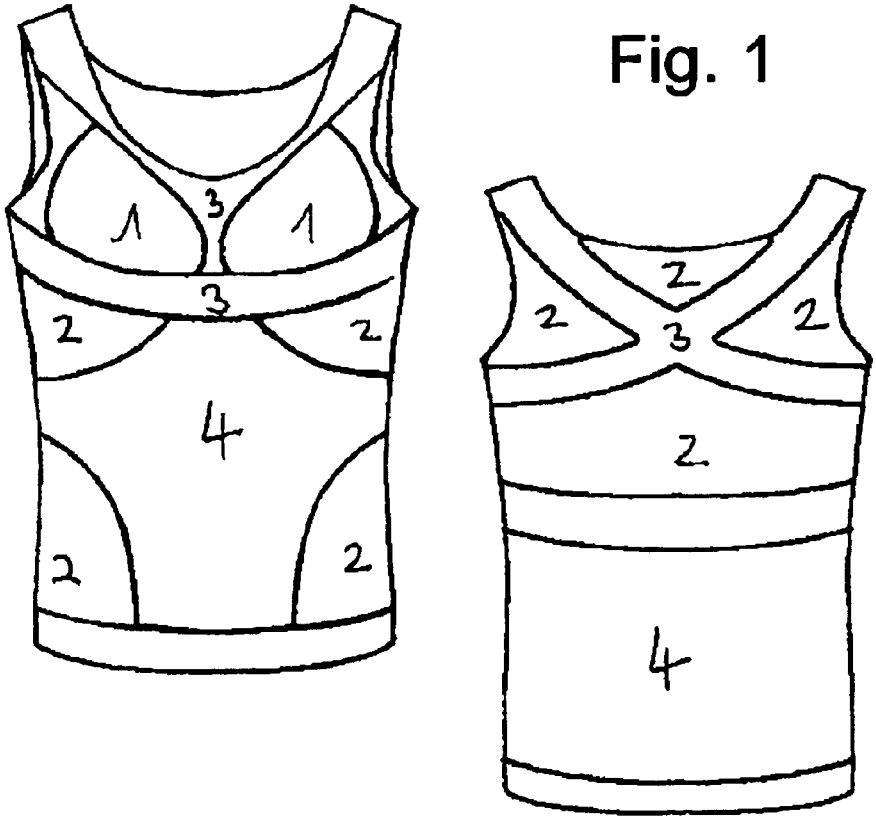
Fig. 1
Fig. 2
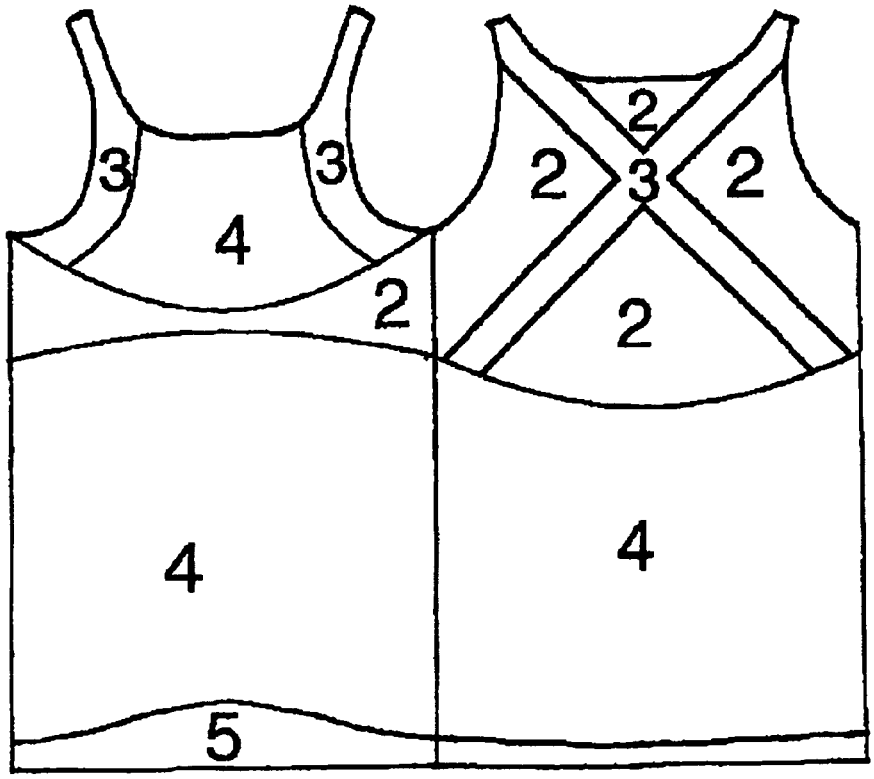

GARMENT

FIELD OF THE INVENTION

The present invention relates to a garment for the torso or the upper part of the body, such as a bustier bra, top, T-shirt, body wrap, body suit, bathing suit or the like, consisting of seamless circular-knit cotton or circular-knit polyamide (microfiber yarn) with a component of elastane fiber, whereby the garment has zones of variable elasticity.

DESCRIPTION OF THE PRIOR ART

From DE-U-202 08 043, for example, a body-massage fabric is known which is seamless circular-knit as knitwear of synthetic fiber with a component consisting of an elastic yarn. The fabric is of bi-elastic design and has lifting or shaping characteristics due to the variable elasticity.

BRIEF SUMMARY OF THE INVENTION

The object of the present invention is to provide garments with special lifting or shaping characteristics which in addition will provide an especially pleasant wearing sensation.

This object is achieved by means of the characterizing part of claim 1. Further developments and advantageous embodiments of the invention are contained in the sub-claims.

According to the invention, a garment for the torso or the upper part of the body, such as a bustier bra, top, T-shirt, body suit or the like, consisting of seamless circular-knit cotton or circular-knit polyamide (microfiber yarn) with a component of elastane, whereby the garment has zones of variable compression, is characterized in that strong compression zones providing greater support are knitted into the garment, and two lamellar support tapes of high compression extend crosswise over the back, and that this can also be achieved by using a stronger yarn, i.e. a higher titer.

According to an advantageous embodiment of the invention, in a women's garment another lamellar compression zone extends below the breast, lifting and shaping it, whereby said lamellar compression zone merges into the lower ends of the crosswise compression zones of the back.

According to another advantageous embodiment of the invention, another lamellar compression zone is arranged circumferentially around the body at the level of the cervical spine and/or the lumbar spine.

According to yet another advantageous embodiment of the invention, the compression zone for the abdominal region extends between the lamellar compression zone in the region of the lumbar spine and the lamellar compression zone, which is arranged below the breast to give it a lift.

In the garment according to the invention, zones of variable transparency and support effect can be provided which may contain information such as size, material composition and/or laundry instructions, which are preferably knitted and integrated into the trim of the material; it can be provided with soft, wide and non-incisive trim sections, it can be provided with a yarn with antibacterial effect, it can be breathable, sweat-absorbing and/or quick-drying, and it may have micromassage naps. It is bi-elastic and form-fitting.

Also according to the invention is a garment for the lower body such as panties, skirt, leggings, underpants, panty hose or the like, made of seamless circular-knit cotton or polyamide yarn (microfiber yarn) with a component of elastane, whereby the garment is provided with zones of variable elasticity, characterized in that strong compression zones and/or support tapes providing a high degree of support are knitted into the garment, that such compression zones are arranged in the abdominal, pelvic and/or thigh region, which can slim the problem zones, and that at least in part, several compression zones of variable elasticity gradually join each other. This can be accomplished by using a stronger yarn, i.e. a higher titer.

According to a special embodiment of the invention, the buttock areas are at least partly surrounded by such supporting compression zones, while they themselves represent zones of low compression, which allows the modelling of the buttock areas. According to an advantageous embodiment, the buttock areas are completely surrounded by such supporting compression zones. According to a special embodiment of the invention, the zones of lower compression in the buttock areas are slightly transparent.

According to another special embodiment of the invention, a circular-knit corset belt is provided with strips of higher compression which extend at least partly in a diamond pattern, border on zones of lower compression in the abdominal and/or buttock region and include zones of medium compression (3) in the pelvic region.

The garment according to the invention can have zones of variable transparency and support effect which may contain particulars such as size, material composition and/or laundry instructions, which are preferably knitted and integrated into the trim of the material; it can be provided with soft, wide and non-incisive trim sections, it can be provided with a yarn with antibacterial action, it can be breathable, sweat-absorbing and/or quick-drying, and it may have micromassage naps. It is bi-elastic and form-fitting.

BRIEF DESCRIPTION OF SEVERAL VIEWS OF THE DRAWINGS

By means of practical examples, the invention is described in detail below with reference to the drawings, where FIG. 1 shows a frontal and rear view of a women's top;

FIG. 2 shows a frontal and rear view of a sleeveless shirt;

DETAILED DESCRIPTION OF THE INVENTION

In FIGS. 1 and 2, the zones of variable compression are identified with numbers in ascending order, whereby 5 indicates the zones of highest compression and 1 the zones of lowest compression, i.e. with the slightest support and lift effect. FIGS. 1 and 2 show a particularly preferred embodiment of the invention in which lamellar zones/tapes of relatively high compression 3 extend from the armpits or from the area below the upper arms to the shoulders and then crosswise over the back.

Figure 3:
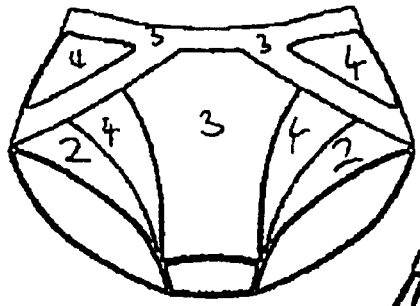
FIG. 3 shows a frontal and rear view of hot pants.
Figure 4:
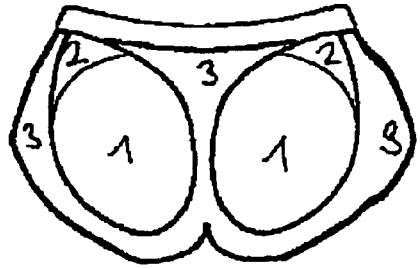
FIG. 4 shows a frontal and rear view of underpants with leg portions.
Figure 4:
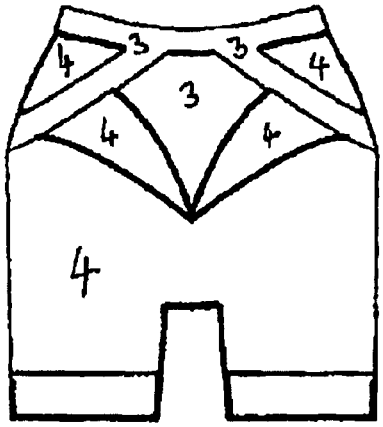
Figure 5:
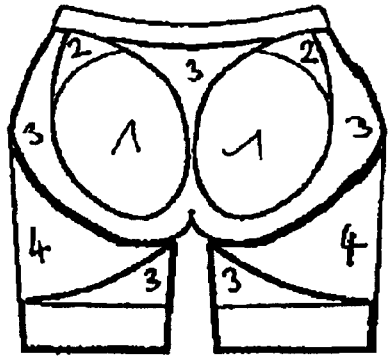
FIG. 5 shows a model wearing underpants, diagonally from the rear.
Figure 5:
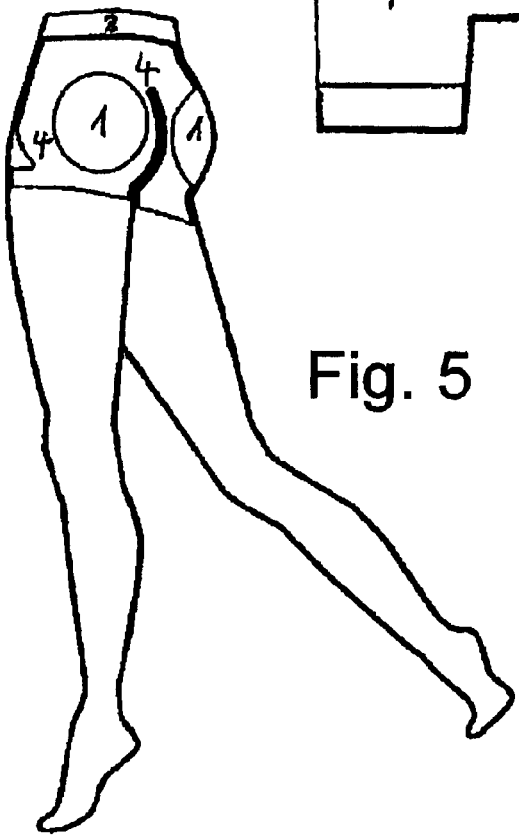
Figure 6:
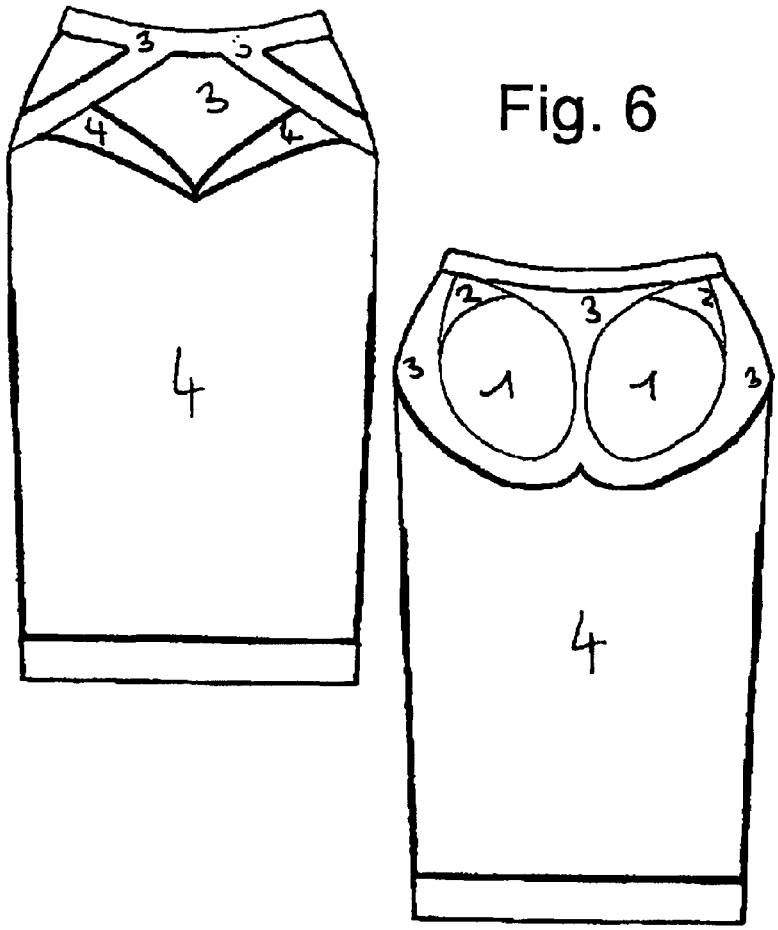
FIG. 6 and FIG. 7 show the frontal and rear view of two versions of skirts.
Figure 7:
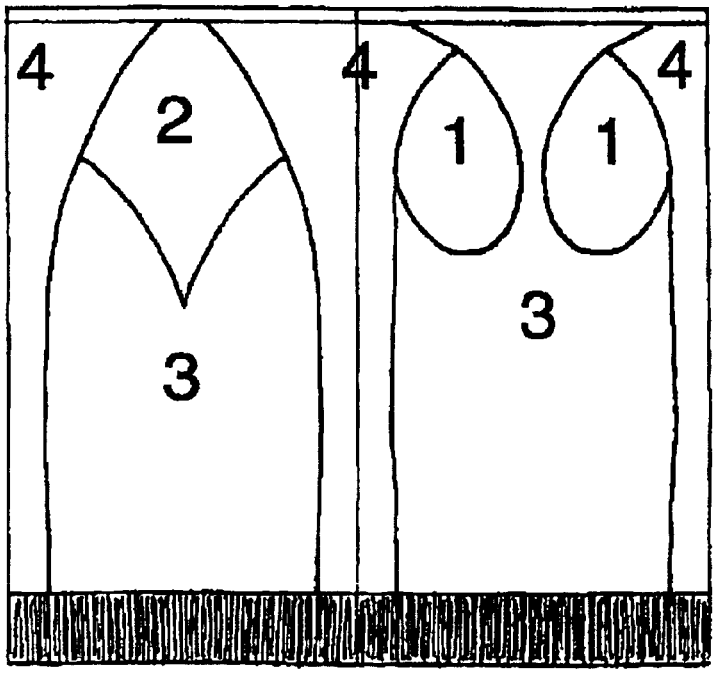

This arrangement has an uplifting and unburdening effect on the upper torso. In the shown in FIG. 1, an extension of the lamellar zone/tape of higher compression runs from the armpits below the breast diagonally across the upper torso, thus exercising a lifting and shaping effect on the breast. The zones of greater compression 4 extend across the lower back region and the abdominal region and serve to shape the figure. In the top/shirt with short or long sleeves shown in FIG. 2, a tape is also provided whose elasticity 5 is yet one degree stronger. The bathing trunks shown in FIG. 3 and abdominal control pants shown in FIG. 4 are also provided with the zones of high compression 4, running primarily around the waist, whereby tapes or strips of medium elasticity 2, 3 are also present, and the breast portion of the bathing suit has low compression with low titer and low yarn strength, while the area that supports the region below the breast has a higher compression.

In FIG. 3 to FIG. 7, the zones of variable elasticity are shown with numbers in ascending order, whereby 1 represents the zones of the lowest compression and 4 the zones of the highest compression, i.e. with the greatest support and modelling effect. It can be seen in FIG. 3 to 7 that the zones of highest compression 4 have a shaping effect on the thighs and that the buttock areas are the zones of the lowest compression 1. Since the buttock areas are surrounded by zones of higher compression 2, 3 (FIGS. 3, 4 and 6), or 4 (FIGS. 5 and 7), the result is a shaping, modeling effect which shows an attractive behind.

Figure 8A:
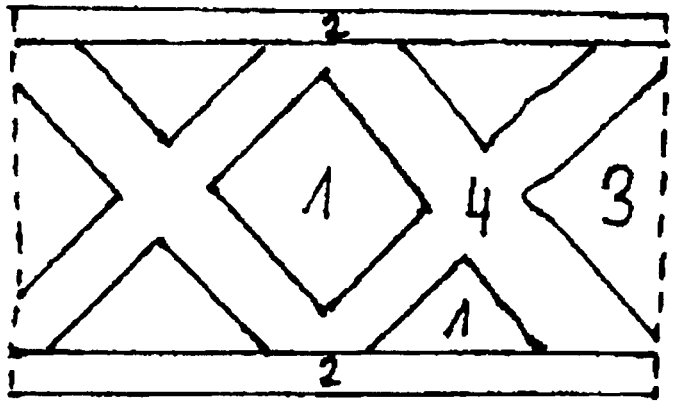
FIG. 8*a* and FIG. 8*b* show the front and rear sides of a circular-knit corset belt.
Figure 8B:
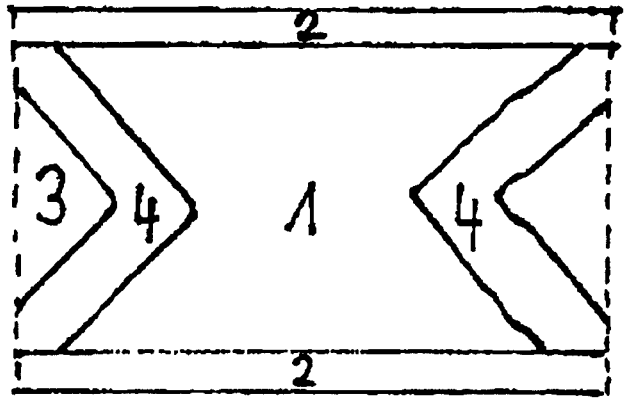

FIG. 8*a* and FIG. 8*b* show a circular-knit corset belt, whereby 8*a* shows the front view and 8*b* the back view. Around the abdominal region of low compression (1), runs a diamond-shaped structure of higher compression (4), which continues across both hips and leaves the buttocks exposed as a zone of low compression (1). At the hips, the diamond-shaped structure of higher compression (4) surrounds areas of medium compression (3), thus producing a shaping, modelling effect. Small cuffs provided above and below have a relatively low compression (2).

Figure 9:
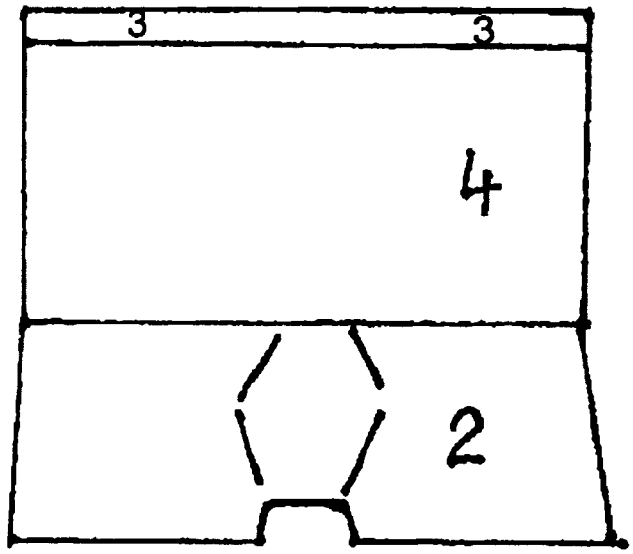
FIG. 9 shows man's underpants.

FIG. 9 shows a man's underpants which is provided with a zone of higher compression (4) around the abdomen and which has leg portions of relatively low compression (2) and a waistband with medium compression (3).

Figure 10:
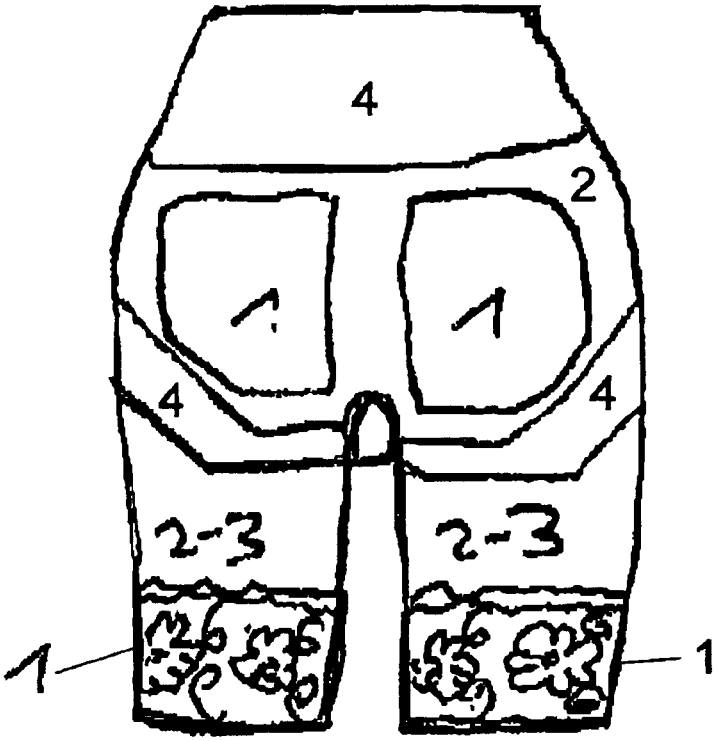
FIG. 10 shows a rear view of corset pants.
Figure 11:
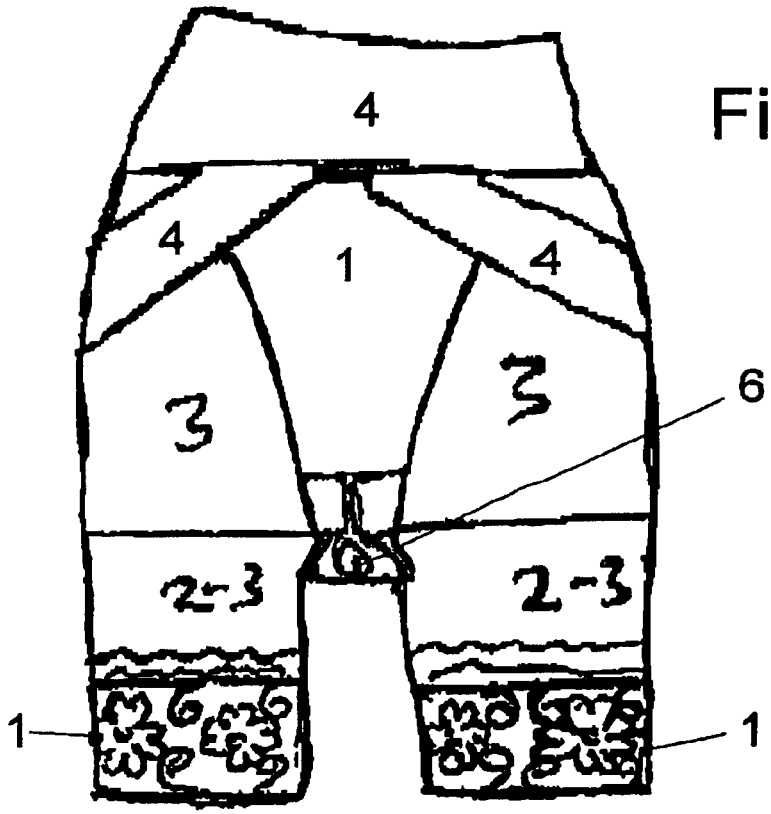
FIG. 11 shows a frontal view of corset pants.

FIGS. 10 and 11 show corset pants with zones of higher compression 4 around the abdomen, whereby such a zone extends behind and below around the buttocks (FIG. 10) before leading diagonally upward in the front to end at the waistband (FIG. 11). In the legs, the corset pants are provided with a band of low compression 1. These corset pants may, for example, be extended to become Capri pants or corset leggings, in which case the area of abdominal support can also be extended upwards. The corset pants are provided with a gusset 6 made of cotton or polyamide. As in the embodiments according to FIG. 3 to 7, the buttock areas are provided with zones of low compression.

Figure 12:
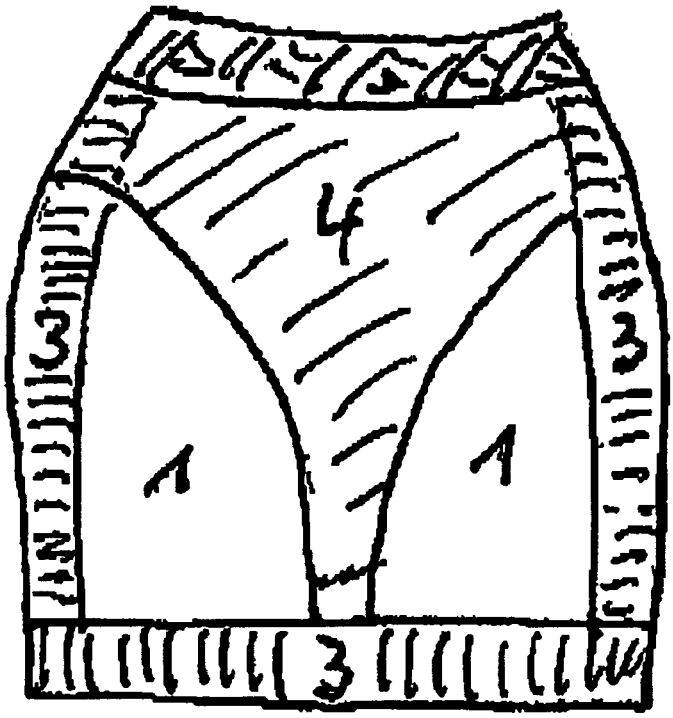
FIG. 12 shows a frontal view of a corset skirt with panty insert.
Figure 13:
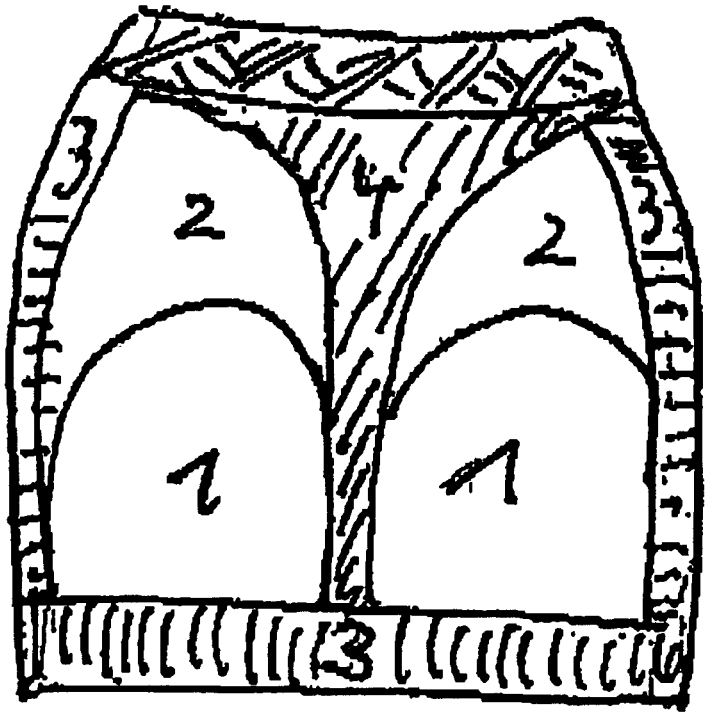
FIG. 13 shows a rear view of a corset skirt with panty insert.

FIGS. 12 and 13 show a corset skirt with a panty insert which is formed of zones of higher compression 4. In the area of the buttocks and in the front of the thighs, zones of low compression 1 are provided, while the areas of the outer thighs are provided with zones of higher compression 3.

Of course, the embodiments shown can be combined with each other and can supplement each other. For example, the upper part of FIG. 1 can be designed in one piece with the pants of FIG. 4 The corset belt of FIGS. 8*a* and 8*b* can be present in the top of FIG. 1 or 2, and so forth.

The invention claimed is:

1. Garment comprising one of seamless circular-knit cotton or circular-knit polyamide (microfiber yarn) with a component of elastane, whereby the garment is provided with zones of variable elasticity (1-5), characterized in that compression zones of higher elasticity (4, 5) are knitted into the garment to provide greater support and in that there are provided two additional lamellar compression supporting zones of higher compression and constructed of one of a belt or a ribbon that are knitted directly into the garment and that extend below the breast for lifting and shaping the garment.

2. Garment according to claim 1, characterized in that the two lamellar supporting compression zones of higher compression (3) extend crosswise over the back.

3. Garment according to claim 2, characterized in that the lamellar compression zone under the breast merges into lower ends of crosswise compression zones in the back.

4. Garment according to claim 1, characterized in that an additional lamellar compression zone is arranged circumferentially around the body at the level of the cervical spine and/or the lumbar spine.

5. Garment according to claim 4, characterized in that the compression zone for the abdominal region extends between the lamellar compression zone in the region of the lumbar spine and the lamellar compression zone which is provided below the breast to lift it.

6. Garment according to claim 1, characterized in that zones of variable transparency and support effect are provided.

7. Garment according claim 1, characterized in that information such as the size, the material composition and/or laundry instructions are knitted into the material.

8. Garment according to claim 1, characterized in that the garment is provided with soft, wide, non-incisive trim sections.

9. Garment according to claim 1, characterized in that the garment is provided with a yarn of antibacterial effect.

10. Garment according to claim 1, characterized in that the garment is breathable, sweat-absorbing and/or quick-drying.

11. Garment according to claim 1, characterized in that the garment is provided with micromassage naps.

12. Garment according to claim 1, characterized in that the garment is bi-elastic and form-fitting.

13. Garment for the lower body, selected from one of panties, G-strings, hot pants, underpants, leggings, panty hose, corset belt or the like, made of one of seamless circular-knit cotton or polyamide yarn (microfiber yarn) with a component of elastane, whereby the garment is provided with zones of variable compression strength including functional zones of higher compression than other of the zones of compression, which therefore provide greater support, are knitted into the garment, whereby such compression zones are arranged in the abdominal, buttock, pelvic, waist and/or thigh regions, which can provide the problem zones with a slender shape, characterized in that, at least in part, one of several zones support tapes of variable compression strength are knitted in the garment and gradually join each other.

14. Garment according to claim 13, characterized in that the buttock areas are at least partly surrounded by such supporting compression zones, while they themselves represent zones of lower compression, thus allowing the buttock areas to be modelled.

15. Garment according to claim 14, characterized in that the buttock areas are completely surrounded by such supporting compression zones.

16. Garment according to claim 14, characterized in that the zones of low compression in the buttock areas can be of transparent design.

17. Garment according to claim 13, characterized in that a circular-knit corset belt is provided in the body suit with strips of higher compression which are at least partly diamond-shaped, which in the abdominal and/or buttock region border on zones of lower compression, and that they enclose zones of medium compression in the pelvic zone.

18. Garment according to claim 13, characterized in that the garment is provided with a yarn of antibacterial effect, whereby the garment can be fitted with antibacterial silver yarn in the armpit and instep regions.

19. Garment according to claim 1, characterized in that the garment is provided with fishnet-like ventilation zones which can also be used as pockets.

20. Garment according to claim 1, characterized in that the inside of the pockets are fitted with electrosmog-repellant yarn.

21. Garment according to claim 13 including a body suit and characterized in that zones of higher elasticity (4, 5), are knitted into the body suit to provide greater support and in that there are provided two additional lamellar compression supporting zones of higher compression and constructed of one of a belt or a ribbon that are knitted directly into the garment and that extend below the breast for lifting and shaping the garment.

* * * * *